US005461942A

United States Patent [19]

Kelley

[11] Patent Number: 5,461,942

[45] Date of Patent: Oct. 31, 1995

[54] KNIFE SHARPENER

[75] Inventor: Andrew T. Kelley, Buffalo, N.Y.

[73] Assignee: Cutco Cutlery Corporation, Olean, N.Y.

[21] Appl. No.: 330,546

[22] Filed: Oct. 28, 1994

[51] Int. Cl.[6] ..... B21K 5/12

[52] U.S. Cl. ..... 73/87; 76/89

[58] Field of Search ..... 76/82, 87, 88, 76/89; D. 8/91, 92, 93; 451/45, 359, 555, 556, 557, 558

[56] References Cited

U.S. PATENT DOCUMENTS

| | | | |
|---|---|---|---|
| D. 145,803 | 10/1946 | Jones | D37/1 |
| D. 173,204 | 10/1954 | Hussar | D37/1 |
| D. 183,530 | 9/1958 | Lamb | D37/1 |
| D. 315,663 | 3/1991 | Dolbosco | D8/93 |
| D. 323,450 | 1/1992 | Shimizu | D8/93 |
| 435,553 | 9/1880 | Blood | 76/89 |
| 668,226 | 2/1901 | Shoemaker . | |
| 1,458,938 | 6/1923 | Heyman | 76/87 |
| 2,446,909 | 8/1948 | Davis | 76/87 |
| 4,112,790 | 9/1978 | Marder | 76/87 |
| 4,498,360 | 2/1985 | Milum | 76/88 |
| 4,751,795 | 6/1988 | Jenne . | |

*Primary Examiner*—Hewi-Siu Payer

*Attorney, Agent, or Firm*—Bean, Kauffman & Spencer

[57] ABSTRACT

A knife sharpener is disclosed having an elongated handle and a blade sharpening unit mounted to a platform at a distal end of the handle for rotation between first and second secured positions for selective orientation of a blade draw direction to accommodate use by either a right-handed or a left-handed individual. The blade sharpening unit includes a lock tab biased for receipt within a selected one of a pair of keyways formed in the platform, each keyway being associated with one of the first and second positions.

9 Claims, 1 Drawing Sheet

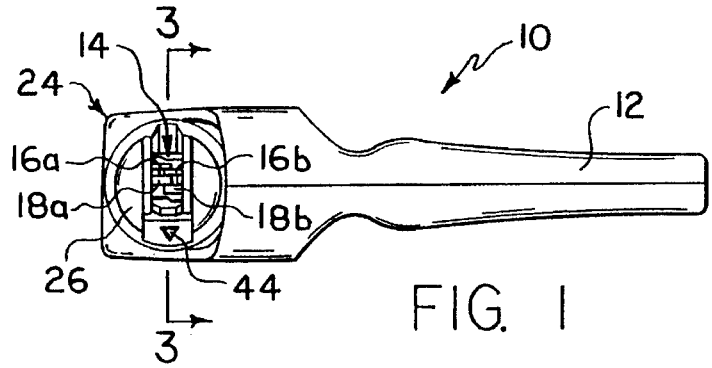
FIG. 1
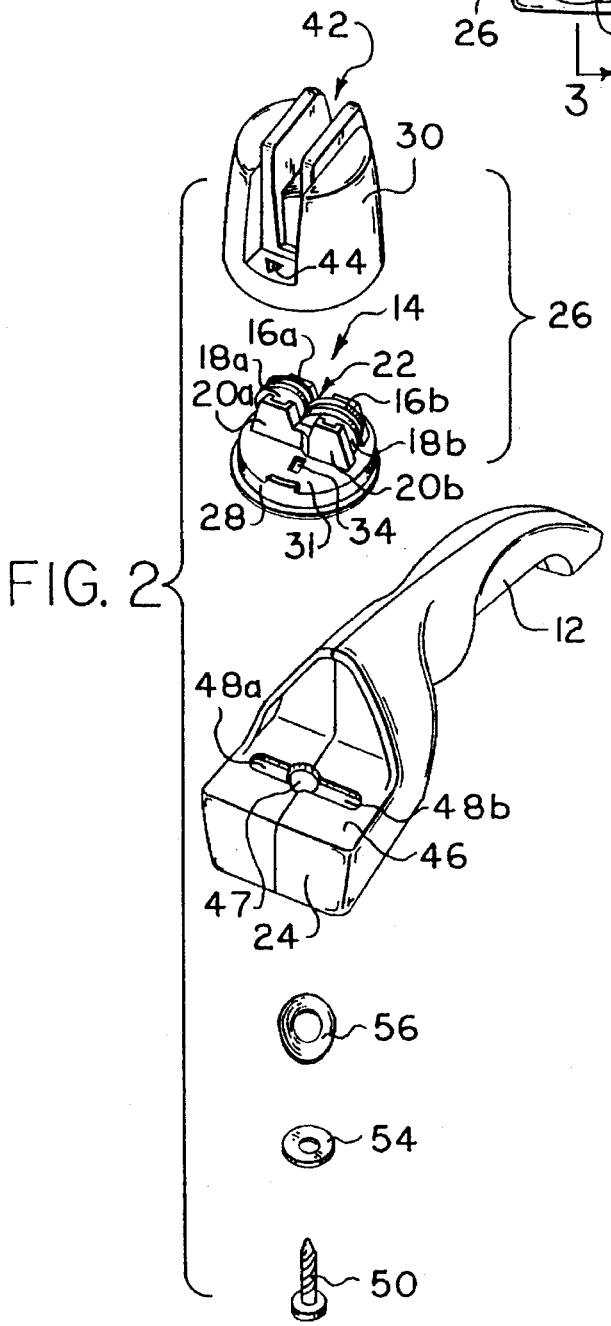
FIG. 2
FIG. 3
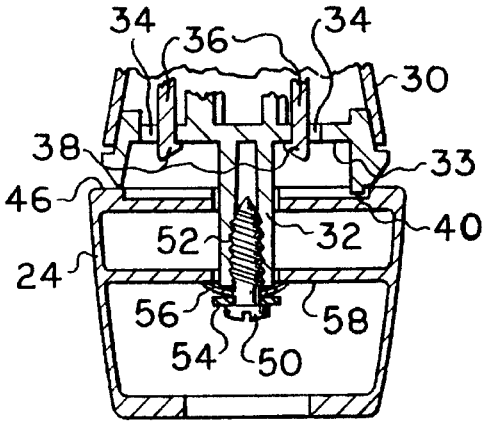

KNIFE SHARPENER

BACKGROUND OF THE INVENTION

1. Field of the Invention

The present invention relates to hand-held knife sharpeners of a type having abrasive blade sharpening means, and more particularly to an improved hand-held knife sharpener having rotatably positionable blade sharpening means for selective accommodation of both right-handed and left-handed users.

2. Description of the Prior Art

Heretofore, hand-held knife sharpeners have typically included a handle to be grasped by a user and abrasive blade sharpening means fixed at an end of the handle and defining a blade draw channel or channels, whereby a knife blade may be sharpened by drawing the blade from heel to point through the channel or channels to frictionally engage the abrasive blade sharpening means. It is known to provide knife sharpeners of this type with blade sharpening means having abrasive honing elements successively arranged "downstream" of blade straightening elements, such that a single predetermined blade draw direction is associated with the knife sharpener. One known form of blade sharpening means comprises a pair of overlapping straightening wheels followed by an adjacent pair of overlapping honing wheels axially aligned with each of the straightening wheels, thereby defining a blade draw channel wherein a blade edge is contacted on opposite sides thereof by each pair of wheels. Because a large majority of knife sharpener users are right-handed, prior art knife sharpeners with a predetermined blade draw direction have been designed and manufactured such that the blade draw direction is generally from left to right, thereby enabling a user to grasp the knife sharpener handle with the left hand and use the right hand to hold a knife to be sharpened and draw it through the blade draw channel.

Such prior art knife sharpeners are ergonomically unsuited for left-handed users, who are forced into right-handed manipulation of the knife, thus compromising safety of use. To this point, knife sharpener manufacturers have lacked economic justification for offering an oppositely designed knife sharpener solely for left-handed users, given the relatively small demand for same in comparison to the demand for knife sharpeners designed solely for right-handed users.

SUMMARY OF THE INVENTION

Therefore, it is an object of the present invention to provide a knife sharpener with means for selectively and easily changing the orientation of a blade draw direction of the knife sharpener to accommodate both right-handed and left-handed users.

It is a further object of the present invention to provide an improved knife sharpener which is ergonomically suitable and safe for use by both right-handed and left-handed users.

In accordance with the present invention, a knife sharpener includes a blade sharpening unit mounted on a platform at a distal end of an elongated handle for rotation between first and second secured positions to enable selective orientation of the blade draw direction, thereby accommodating either a right-handed or a left-handed user.

The blade sharpening unit comprises a pair of straightening wheels and a pair of honing wheels arranged to define a blade draw channel having a particular blade draw direction. A downwardly extending shaft of the blade sharpening unit is slidably received within a hole provided through the platform, and a screw threadably engaged with a threaded portion of the shaft connects the blade sharpening unit to the platform for rotation about a vertical axis defined by the shaft. The blade sharpening unit also includes a downwardly extending lock tab which may be aligned for receipt within a selected one of a pair of recessed keyways formed in the platform, each keyway being associated with an alternate one of the first and second positions of the blade sharpening unit. A spring washer associated with the screw biases the lock tab for receipt within a selected keyway to secure the blade sharpening unit in position.

BRIEF DESCRIPTION OF THE DRAWING

The nature and mode of operation of the present invention will now be more fully described in the following detailed description taken with the accompanying drawing figures wherein:

FIG. 1 is a top plan view of a knife sharpener formed in accordance with the present invention with a blade draw direction thereof oriented to accommodate a left-handed user;

FIG. 2 is an exploded perspective view thereof; and

FIG. 3 is a sectional view taken generally along the line 3—3 in FIG. 1.

DETAILED DESCRIPTION

An improved knife sharpener formed in accordance with the present invention is shown in FIGS. 1–3 and designated generally as 10. Knife sharpener 10 is conventional in that it includes an elongated handle 12 having blade sharpening means 14 located at an end thereof. In a preferred embodiment, blade sharpening means 14 comprises a pair of radially overlapping steel straightening wheels 16*a* and 16*b* and a pair of radially overlapping ceramic honing wheels 18*a* and 18*b* axially aligned with straightening wheels 16*a* and 16*b*, respectively. Straightening wheel 16*a* and honing wheel 18*a* are pivotally mounted for rotation about an axle (not shown) extending between supports 20*a*, while straightening wheel 16*b* and honing wheel 18*b* are mounted in similar fashion on an axle (not shown) extending between supports 20*b*. The overlapping configuration of straightening wheels 16*a* and 16*b* and honing wheels 18*a* and 18*b* serves to define an axially extending, generally V-shaped blade draw channel 22 having a predetermined blade draw direction.

In accordance with the present invention, handle 12 includes a platform 24 at a distal end thereof, and blade sharpening means 14 is part of a separately constructed blade sharpening unit 26 which is rotatably mounted on platform 24 for manual rotation between first and second secured positions such that knife sharpener 10 may be utilized in a safe and comfortable manner by either a right-handed or left-handed individual.

Blade sharpening unit 26 preferably comprises a disc-shaped base portion 28 and a cover portion 30 releasable attachable to the base portion. Base portion 28 includes integrally formed supports 20*a* and 20*b* extending upwardly from a top surface 31 thereof and an integrally formed elongated cylindrical shaft 32 extending downwardly from a bottom surface 33 thereof, and a pair of opposite radially extending latch slots 34 for receiving a pair of opposite spring latches 36 each extending downwardly from cover portion 30 and having a protrusion 38 at an end thereof normally biased to underengage bottom surface 33 and configured for releasable "snap-fit" attachment of cover portion 30 to base portion 28. Base portion further includes a circumferentially located lock tab 40 arranged in radial alignment with latch slots 34 and extending downwardly from bottom surface 33. In addition to spring latches 36, cover portion 30 further includes a diametrically extending channel opening 42 aligned to expose blade draw channel 22, and direction indicator means in the form of an arrow 44 for visibly indicating the blade draw direction. With blade sharpening means 14 mounted on supports 20*a* and 20*b*, cover portion 30 may be snap-fit to base portion 28 to form blade sharpening unit 26.

Platform 24 comprises a horizontally planar support surface 46 having a central hole 47 therethrough for slidably receiving shaft 32, and a pair of recessed keyways 48*a* and 48*b* for selectively receiving lock tab 40 when blade sharpening unit is in a first position for a right-handed user and a second position for a left-handed user, respectively. While keyways 48*a* and 48*b* are shown in a preferred orientation 180 degrees apart such that the blade draw direction is substantially perpendicular to the longitudinal axis of handle 12, it will be understood that alternative orientations for keyways 48*a* and 48*b* are possible and are considered within the scope of the present invention.

A preferred means for mounting blade sharpening unit 26 on platform 24 includes a screw 50, which may be a self-tapping screw, threadably engaged with an internally threaded portion 52 of shaft 32, a flat washer 54 mounted adjacent the head of screw 52, and a spring washer 56 mounted adjacent flat washer 54 and arranged to engage a biasing surface 58 provided in platform 24. In this way, blade sharpening unit 26 is mounted on platform 24 for rotation about a vertical axis defined by shaft 32. Spring washer 56 acts to resiliently bias the blade sharpening unit for engagement with support surface 46. More specifically, as blade sharpening unit 26 is rotated from one secured position to the other secured position, lock tab 40 is forced out of one keyway 48*a* or 48*b* and into engagement with support surface 46, thereby axially lifting blade sharpening unit 26 and loading spring washer 56, such that lock tab 40 is urged downwardly into the other keyway 48*b* or 48*a* upon subsequent alignment therewith to secure blade sharpening unit 26 in the other position.

Thus, the present invention is simple in operation. To selectively orient the blade draw direction for right-handed use, the user merely grasps blade sharpening unit 26 and manually rotates it relative to platform 24 until lock tab 40 is urged within keyway 48*a*. Orientation of the blade draw direction for a left-handed user is accomplished in a similar manner, however with lock tab 40 being received within alternate keyway 48*b*. To determine the present orientation of the blade draw direction, the user may refer to arrow 44.

What is claimed is:

1. A knife sharpener comprising:

an elongated handle; and a blade sharpening unit including abrasive blade sharpening means, said abrasive blade sharpening means defining a generally transversely extending blade draw channel having only one predetermined blade draw direction;

said sharpening unit being mounted at a distal end of said handle for rotation relative to said handle between first and second secured positions to change the orientation of said blade draw direction relative to said handle;

whereby said blade draw direction may be selectively oriented to accommodate a right-handed or a left-handed user of said knife sharpener.

2. A knife sharpener according to claim 1, wherein said handle includes a mounting platform at said distal end having a central opening therethrough, and said sharpening unit includes a downwardly extending shaft slidably received within said opening to permit rotation about an axis of said shaft, and biasing means connected to said shaft for urging said sharpening unit against said platform.

3. A knife sharpener according to claim 2, wherein said mounting platform includes a pair of keyways and said sharpening unit includes a lock tab arranged for receipt within one of said pair of keyways when said sharpening unit is in said first position and the other of said pair of keyways when said sharpening unit is in said second position.

4. A knife sharpener according to claim 3, wherein said first and second positions are 180 degrees opposite each other about said axis.

5. A knife sharpener according to claim 2, wherein said shaft includes a threaded portion and said sharpening unit is coupled to said platform by screw means engaging said threaded portion.

6. A knife sharpener according to claim 5, wherein said biasing means includes a spring washer mounted on said screw means.

7. A knife sharpener according to claim 2, wherein said platform is integrally formed with said handle.

8. A knife sharpener according to claim 1, wherein said sharpening unit comprises a base portion for supporting said blade sharpening means and a cover portion releasably attached to said base portion, said cover portion exposing said blade draw channel.

9. A knife sharpener according to claim 1, wherein said sharpening unit includes indicator means for indicating said blade draw direction.

* * * * *